US006086685A

United States Patent [19]

Jöller et al.

[11] Patent Number: 6,086,685

[45] Date of Patent: Jul. 11, 2000

[54] PROFILED ROLLING STOCK AND METHOD FOR MANUFACTURING THE SAME

[75] Inventors: Albin Jöller; Peter Pointner; Herbert-Adolf Schifferl, all of Leoben, Austria

[73] Assignee: Voest-Alpine Schienen GmbH, Loeben, Austria

[21] Appl. No.: 08/994,190

[22] Filed: Dec. 19, 1997

[30] Foreign Application Priority Data

Dec. 19, 1996 [AU] Australia ..... A 2222/96

[51] Int. Cl.[7] ..... C21D 9/04; C22C 38/02; C22C 38/06

[52] U.S. Cl. ..... 148/320; 148/334; 148/335; 148/581; 148/637

[58] Field of Search ..... 148/320, 334, 148/335, 581, 637, 903, 584

[56] References Cited

U.S. PATENT DOCUMENTS

| | | | |
|---|---|---|---|
| 5,209,792 | 5/1993 | Besch et al. | 148/581 |
| 5,382,307 | 1/1995 | Kageyama et al. | 148/584 |
| 5,759,299 | 6/1998 | Yokoyama et al. | 148/584 |

FOREIGN PATENT DOCUMENTS

| | | |
|---|---|---|
| 399346 | 9/1994 | Australia . |
| 0136613 | 4/1985 | European Pat. Off. . |
| 018633 | 7/1986 | European Pat. Off. . |
| 293002 | 11/1988 | European Pat. Off. . |
| 0358362 | 3/1990 | European Pat. Off. . |
| 0441166 | 8/1991 | European Pat. Off. . |
| 0693562 | 1/1996 | European Pat. Off. . |
| 3336006 | 4/1985 | Germany . |
| 96/22396 | 7/1996 | WIPO . |

*Primary Examiner*—Deborah Yee
*Attorney, Agent, or Firm*—Greenblum & Bernstein, P.L.C.

[57] ABSTRACT

A profiled rolling stock, in particular a running rail or railroad track made of an iron-based alloy, is provided. The alloy contains silicon plus aluminum below 0.99 wt. % of the rolling stock. A structure in the cross section is formed, at least partially, by isothermic structural transformation due to accelerated cooling from the austenite region of the alloy to a lower intermediary phase temperature and holding. Transformation preferably occurs between the martensite transformation point of the alloy a temperature 250° C. over the martensite transformation point Ms.

51 Claims, 3 Drawing Sheets

PROFILED ROLLING STOCK AND METHOD FOR MANUFACTURING THE SAME

CROSS-REFERENCE TO RELATED APPLICATIONS

The present application claims priority under 35 U.S.C. § 119 to Austrian Patent Application No. A 2222/96, filed Dec. 19, 1996, the disclosure of which is expressly incorporated by reference herein in its entirety.

BACKGROUND OF THE INVENTION

1. Field of the Invention

The present invention relates to a profiled rolling stock. More particularly, the present invention relates to rolling stock as a running rail or railroad track made of an iron-based alloy of carbon, silicon, manganese, chromium, elements that form special carbides and/or micro-alloy additives that influence the transformation behavior of the material, residual iron, and both standard and manufacture conditional impurities, with a cross section formed at least in part by accelerated cooling from the austenite region of the alloy. The present invention also relates to a process for producing profiled rolling stock having the above properties.

2. Background and Material Information

Rolling stock can be stressed in different ways based upon the field of use. Due to properties of the material, the highest individual stress places demands on the size of the component, which affects its longevity. For technical and economic reasons, adjusting the amount of material components to certain requirements can provide advantages according to the distinct individual stresses generated within a particular field of use. This is especially the case for a field of use in which different parts of the same component are subject to different stress levels.

Railroad tracks are an example of a metal unit that experiences different levels of stress. On the one hand, the top surface of the rails (the rail head) requires a high degree of wear resistance to support train wheels. On the other hand, due to bending stress in the track from the weight of train traffic, the track requires a high degree of strength, toughness, and fracture resistance in the remaining cross section.

To improve the service properties of the rails with increasing traffic and ever greater axle loads, many proposals have been made to increase rail head hardness.

For example, AT-399346-B discloses a process in which the rail head in the austenite phase of the alloy is dipped into, and then removed, from a coolant having a synthetic coolant additive until a surface temperature of the rail drops to between 450° C. and 550° C. This forms a fine pearlite structure with an increased material hardness. To carry out the process, EP 441166-A discloses a device that submerges the rail head into a basin that contains the appropriate coolant.

EP-186373-B1 shows another process for forming a stable pearlite structure in rails. A nozzle dispenses coolant to cool the rails. The distance between the nozzle and the rail head is a function of (1) the hardness value to be achieved for the rail head and (2) the carbon equivalent of the steel.

Examples of devices for carrying out this process for the heat treatment of profiled rolling stock, such as rails, are shown in (1) EP-693562-A, which discloses forming a fine pearlite structure with an increased hardness and abrasion resistance, and (2) EP-293002, which discloses producing a fine pearlitic structure in the rail head by cooling the rail head to 420° C. with hot water jets followed with air jets.

EP-358362-A discloses a process in which the rail head is cooled rapidly from the austenite region of the alloy to a selected temperature above the martensite transformation point (the temperature at which the alloy transforms into martensite). After reaching the selected temperature, the cooling process levels off. The material undergoes a complete isothermic conversion into the lower pearlite phase to form a pearlite microstructure. According to the chemical composition of the steel, this transformation should occur without forming bainite.

EP-136613-A and DE-33 36 006-A teach producing a rail with a high wear resistance in the head and high fracture resistance in the foot. After rolling and air cooling, the rail is austenitized at 810° C. to 890° C. and cooled in an accelerated fashion. A fine pearlitic structure is produced in the region of the head and a martensitic structure is produced in the region of the foot, which is tempered afterwards.

According to these above prior art methods, a rolling stock for use in a railroad track with a high wear resistance in the head and a high strength and toughness in the remainder requires a fine pearlite structure. Further, an intermediary phase/bainite structure (possibly containing martensite) must be avoided.

Atoms diffuse during pearlite conversion. As the temperature drops, the speed of nucleation for the lamellar phases of carbide and ferrite increases, which forms the pearlite. This produces an increasingly fine pearlite structure that is stronger and more abrasion resistant. The pearlite formation therefore occurs via nucleation and growth, which the extent of the super-cooling and the diffusion speed determines, particularly for carbon and iron atoms.

If the cooling speed is further increased, or the conversion temperature is further decreased, carbon-containing, low-alloyed iron-based materials transform into a bainitic or an intermediary phase structure. It is hypothesized that in such an intermediary phase transformation (or bainite conversion) the fundamental lattice atoms are frozen and cannot diffuse. The structural transformation therefore occurs by shearing of the lattice. However, the smaller carbon atoms can still diffuse to form carbides. Such a structure, formed immediately below the temperature region of the conversion to fine lamellar pearlite (i.e., formed in the intermediary phase transformation), has a much coarser form. The carbides produced are markedly larger and disposed between the ferrite lamellas. This significantly degrades material toughness and material fatigue. The finished article is easier to fracture, particularly under abrupt stress. Consequently, rails should not contain any bainite content in the structure.

WO 96/22396 discloses a carbide-free bainitic steel with a high degree of wear resistance and improved contact fatigue resistance. A low-alloy steel with high silicon and/or aluminum contents of 1.0–3.0 wt. %, 0.05–0.5 wt. % carbon, 0.5–2.5 wt. % manganese, and 0.25–2.5 wt. % chromium, cooled continuously from the rolling temperature produces substantially carbide-free microstructure rolling stock of the "upper bainite" type. This "upper bainite structure type" is a mixed structure of bainitic ferrite, residual austenite, and high carbon martensite. However, at low temperatures and/or when there are mechanical stresses, at least part of the residual austenite in the structure can shear and form martensite and/or a so-called deformation martensite. This increases the danger of crack initiation, especially at the phase boundaries.

An increase in the advent of traffic on the rail segments and higher axle loads and train speeds in general require higher material qualities and should also be achieved through improved service properties of rails.

A drawback of the prior art rolling stock produced from low-alloyed iron-based materials, and the associated processes (particularly heat treatment processes) for producing rolling stock with improved service properties, is that a further increase in the wear resistance and strength of the material can only be achieved through expensive technical alloying measures.

SUMMARY OF THE INVENTION

The present invention provides a profiled rolling stock, in particular a railroad track, with an optimal combination of wear resistance, abrasion resistance, toughness, material hardness, and resistance to contact fatigue. The present invention further provides a new economical process which improves the service properties of profiled rolling stock.

According to an embodiment of the present invention, there is provided a profiled rolling stock of an iron-based alloy containing up to about 0.93 silicon. A structure over the cross section is formed, at least partially, by accelerated cooling from the austenite region of the alloy. The structure is substantially the result of isothermic structural transformation as the alloy is cooled from the austenite phase of the alloy to a lower intermediary temperature region above the martensite transformation point.

According to a feature of the above embodiment, the concentration of silicon is within about 0.21 to 0.69 wt % of the iron-based alloy.

According to a further feature of the above embodiment, the alloy has up to about 0.06 wt % of aluminum, preferably up to about 0.03%, and a total amount of the silicon and the aluminum is up to about 0.99 wt % of the iron-based alloy.

According to a yet further feature of the above embodiment, the iron-based alloy includes about 0.41 to 1.3 wt % carbon, about 0.31 to 2.55 wt % manganese, and iron. Preferably, carbon is about 0.51 to 0.98 wt % of the iron-based alloy, while manganese is about 0.91 to 1.95 wt % of the iron-based alloy.

According to a further feature of the above embodiment, the iron-based alloy includes about 0.21 to 2.45 wt % chromium, preferably about 0.39 to 1.95 wt % chromium.

According to a yet further feature of the above embodiment, the iron-based alloy includes up to about 0.88 wt % molybdenum, preferably up to about 0.49 wt % molybdenum.

According to a yet another feature of the above embodiment, the iron-based alloy includes up to about 1.69 wt % tungsten, preferably up to about 0.95 wt % tungsten.

According to yet a further feature of the above embodiment, the iron-based alloy includes up to about 0.39 wt % vanadium, preferably up to about 0.19 wt % vanadium.

According to a yet still further feature of the above embodiment, the iron-based alloy includes up to about 0.28 wt % total niobium, tantalum, zirconium, hafnium, and titanium. preferably up to about 0.19 wt % total niobium, tantalum, zirconium, hafnium, and titanium.

According to a still further feature of the above embodiment, the iron-based alloy includes up to about 2.4 wt % nickel, preferably up to about 0.95 wt % nickel.

According to yet another feature of the above embodiment, the iron-based alloy includes up to about 0.006 wt % boron, preferably up to about 0.004 wt % boron.

According to yet another feature of the above embodiment, an amount of silicon, aluminum, and carbon, in wt %, in the iron-based alloy satisfies the following relationship:

$$2.75(\text{silicon}+\text{aluminum})-\text{carbon}\leqq 2.2$$

According to yet still another feature of the above embodiment, the rolling stock is a railroad track including a rail head, a rail foot, and an intermediary piece connecting the rail head and rail foot. The structure reaches at least about 10 mm below a surface of the rail head, preferably at least about 15 mm below the surface of the rail head.

According to a further feature of the above embodiment, the structure is disposed symmetrically about a longitudinal axis of the rolling stock.

According to a yet further feature of the above embodiment, any portion of the rolling stock containing the structure has a hardness of at least about 350 HB, preferably at least about 400 HB, and particularly between about 420 HB to 600 HB.

According to another embodiment of the invention, there is provided a method for producing profiled rolling stock from an iron-based alloy containing at least silicon, including selecting a concentration of the components of the alloy, cooling at least a portion of the cross section of the rolling stock from the austenite temperature region of the alloy to a transformation temperature range within a lower intermediary temperature region of the alloy between the martensite transformation point of the alloy and about 250° C. above the martensite transformation point, and permitting the alloy to isothermically transform.

According to a feature of the above embodiment, the lower intermediary temperature region is between the martensite transformation point of the alloy and about 190° C. above the martensite transformation point, preferably between about 5° C. above the martensite transformation point of the alloy and about 110° C. above the martensite transformation point.

According to still another feature of the above embodiment, the transformation temperature range is less than or equal to about 220° C. wide, preferably less than of equal to about 120° C. wide.

According to a still yet another feature of the above embodiment, an upper limit of the transformation temperature range is less than or equal to about 450° C., preferably less than or equal to about 400° C.

According to a still further feature of the above embodiment, a lower limit of the transformation temperature is above about 300° C., and an upper limit of the transformation temperature range is below about 380° C.

According to yet a further feature of the above embodiment, at least a portion of a cross section of the rolling stock has a higher mass subject to an accelerated cooling.

According to a yet still further feature of the above embodiment, the cooling includes applying coolant to a surface of the rolling stock in an amount and in a manner based on a mass of the rolling stock.

According to yet another feature of the above embodiment, cooling includes immersing the rolling stock into a coolant until at least a portion of the surface has a surface temperature least 2° C., preferably at least about 160° C., above the martensite transformation point of the alloy, at least partially removing the rolling stock from the coolant, and intermittently cooling only those sections of the rolling stock having the highest mass.

According to yet a still further feature of the above embodiment, the alloy is axially aligned before cooling.

According to yet another feature of the above embodiment, after at least partial thermal transformation of the alloy during the permitting, the alloy is straightened at a temperature greater than or equal to room temperature to obtain the particular material properties with a stable alignment of the material.

According to yet another further feature of the above embodiment, the permitting includes maintaining the alloy within the transformation temperature range for a predetermined period of time.

According to yet another embodiment of the invention, there is provided a profiled rolling stock made of an iron-based alloy including carbon, silicon, manganese, and at least one of chromium, elements that form special carbides that also influence the conversion behavior of the material, micro-alloy additives, residual iron, and both standard and manufacture conditional impurities. A structure is formed over the cross section at least partially by isothermic structural conversion from accelerated cooling from the austenite region of the alloy in the region of the lower bainite stage. The iron-based alloy has a concentration, in wt. %, of up to about 0.93% silicon, up to about 0.06%aluminum and a total of silicon plus aluminum below about 0.99%.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

Figure 1:
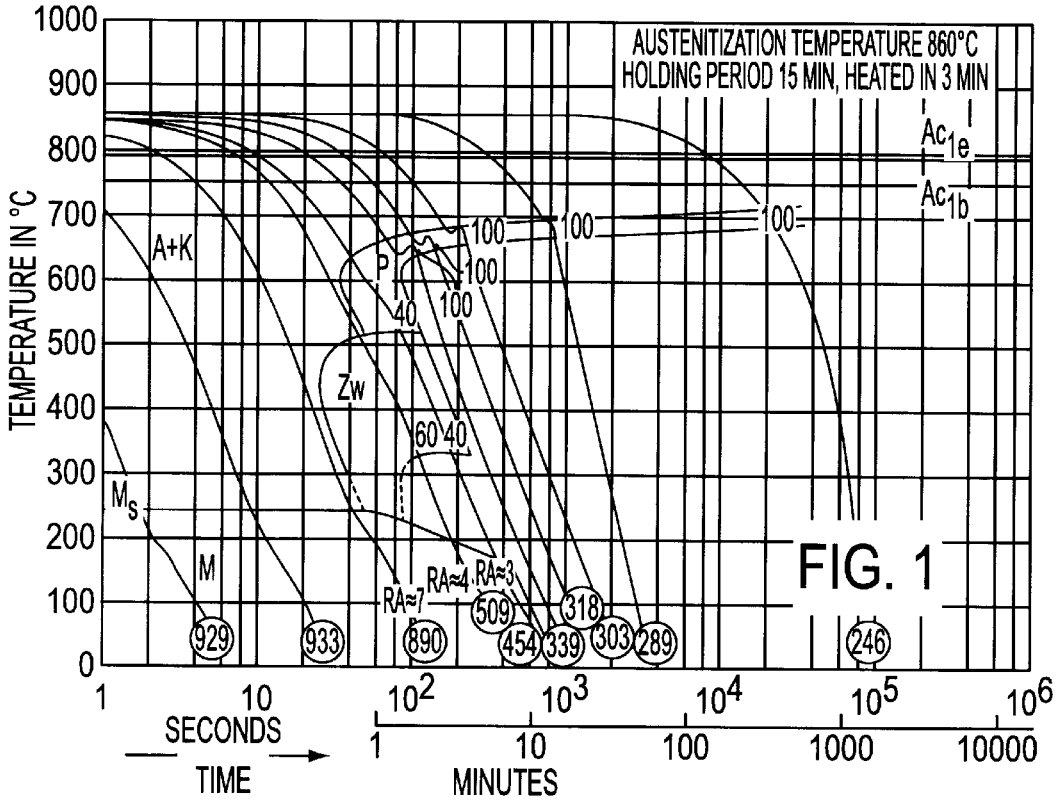
FIG. 1 is a continuous time-temperature transformation curve of an alloy from an austenitizing temperature of 860° C.

The particulars shown herein are by way of example and for purposes of illustrative discussion of the preferred embodiments of the present invention only and are presented in the cause of providing what is believe to be the most useful and readily understood description of the principles and conceptual aspects of the invention. In this regard, no attempt is made to shown structural details of the invention in more detail than necessary for the fundamental understanding of the invention, the description taken with the drawings making apparent to those skilled in the art how the several forms of the invention may be embodiment in practice.

The present invention is directed to an iron-based alloy having silicon and/or a combination of silicon and aluminum as follows:

| Material | Maximum range (wt %) | Preferred range (wt %) |
|---|---|---|
| Silicon | Up to 0.93 | 0.21 to 0.69 |
| Aluminum | Up to 0.06 | Up to 0.03 |
| Silicon + Aluminum | Up to 0.99 | Up to 0.72 |

In addition, at least part of a cross section of the rolling stock taken across its length has a microstructure produced by an isothermic transformation of the austenite at a temperature at which the lower intermediary structure (i.e, the lower bainite) is formed. The structure so formed is hereinafter referred to as the "lower intermediary phase structure".

It has been found that a rolling stock with a lower intermediary phase structure produced by transformation in the lower intermediary region has significantly improved mechanical properties compared with the prior art. The above ranges of silicon and/or aluminum content of the alloy are prerequisites to the structural transformation; higher silicon and/or aluminum concentrations in low-alloyed iron-based materials have a constricting effect on the gamma region in the state of the phase system and that prevent a complete transformation from the austenite phase into the lower intermediary phase structure.

Presently, there is no confirmed explanation for the surprisingly great improvement of material properties between transformation in the lower intermediary region as opposed to transformation at higher temperatures (i.e., an upper intermediary region). One hypothesis is that in the upper intermediary region, diffusion of the lattice atoms is frozen, while the carbon can still diffuse slightly. This produces coarse carbide precipitations disposed between the ferrite needles, which degrades material properties; these particles are visible under a standard microscope.

In contrast, carbon diffusion appears to be significantly reduced (or frozen) in the temperature region of the lower intermediate phase transformation. Carbides formed in the needles of the intermediary stage ferrite are finely distributed, and are so small that they can only be detected with an electron microscope. The reduced size and distribution of the carbides in the lower intermediary phase structure significantly improves the hardness, strength, toughness, fracture resistance, wear resistance, abrasion resistance, and contact fatigue resistance of the rolling stock.

The material properties of the rolling stock are further improved when the iron-based alloy contains, in wt %, at least one of the following:

| Material | Maximum range (wt %) | Preferred range (wt %) |
|---|---|---|
| Carbon | 0.41 to 1.3 | 0.51 to 0.98 |
| Manganese | 0.31 to 2.55 | 0.91 to 1.95 |

The balance of the alloy is preferably iron.

The material properties of the rolling stock are still further improved when the iron-based alloy furthermore contains, in wt. %, at least one of the following:

| Material | Maximum range (wt %) | Preferred range (wt %) |
|---|---|---|
| Chromium | 0.21 to 2.45 | 0.38–1.95 |
| Molybdenum | Up to 0.88 | Up to 0.49 |
| Tungsten | Up to 1.69 | Up to 0.95 |
| Vanadium | Up to 0.39 | Up to 0.19 |
| Total of niobium, tantalum, zirconium, hafnium, and titanium, | Up to 0.28 | Up to 0.19 |
| Nickel | Up to 2.4 | Up to 0.95 |
| Boron | Up to 0.006 | Up to 0.004 |

To complete the transformation in the lower intermediary region of the alloy without producing mixed structures, it is preferable that concentration of silicon, aluminum, and carbon satisfy the following relationship (in wt %):

$$2.75(\text{silicon}+\text{aluminum})-\text{carbon}\leqq 2.2\%$$

By conforming to this relationship, strong ferrite-forming elements (e.g., silicon and aluminum), and the effectively austenite-forming carbon associate with one another in a conversion-kinetic manner, or are matched to one another.

In a profiled rolling stock, in particular a railroad track having a rail head, a rail foot, and an intermediary piece that connects these regions, the lower intermediary phase structure reaches at least 10 mm, and preferably at least 15 mm, below the surface. As a result, even highly stressed surface regions are highly stable. Further, if the structure is symmetrical about the longitudinal axis of the rail, the stock has improved stability in the longitudinal direction and reduced internal stresses.

It is also preferable that the rolling stock has a hardness of at least 350 HB, preferably at least 400 HB, and in particular from 420 to 600 HB in the region(s) which contain the lower intermediary phase structure.

To achieve the above finished product, the alloy composition is selected from within the above noted ranges. Transformation during cooling from the austenite region is detected and the rolling stock is produced from the selected alloy. In the longitudinal direction, at least part of the cross section of the rolling stock is cooled from the austenite region to a temperature range within the lower intermediary region. The transformation temperature range falls between the martensite transformation point Ms of the alloy and a value that exceeds the martensite transformation point by a maximum of 250° C., preferably by at most 190° C. In particular, the temperature range is disposed within the region of 5° C. to 110° C. above the martensite transformation point. The lower intermediary phase structure is permitted to transform at this temperature in an essentially isothermic manner.

The above process provides precise manufacturing and quality planning for the profiled rolling stock with significant improvement in mechanical properties. The range of components allows for a reasonably priced chemical alloy composition. It is also possible to stipulate and respectively use a precise, comprehensive production and heat treatment technology. This is important because the conversion process during cooling from the austenite region of the alloy depends not only on the composition of the alloy, but also on the level of the end rolling temperature and/or the austenitizing temperature, the nucleation state, and the speed of nucleation for phases or the lattice shearing mechanism. The transformation temperature can be adjusted based on the respective conversion behavior or the martensite transformation temperature Ms of the material for a given state, or can be adjusted in practical production.

Particularly advantageous material properties are achieved when the lower intermediary phase structure is formed isothermically in a transformation temperature range ±10° C. from the average transformation temperature (i.e., the maximum and minimum temperature during cooling should not differ by more than 220° C.), preferably of at most ±60° C. For most steels that are used for high stress rolling products, particularly railroad tracks, this results in a conversion temperature of at most 450° C., preferably of at most 400° C., in particular from 300 to 380° C., to produce the lower intermediary phase structure.

If at least one part of the cross section of the profiled rolling stock that has a large mass concentration (i.e., areas with a high ration of volume to surface are) is subject to accelerated cooling, a favorable and uniform cooling over the cross section can be applied along the longitudinal axis of the rolling stock.

To improve uniform cooling over the cross section, particularly in rail tracks, the rolling stock is immersed completely in a coolant until the stock's surface reaches a temperature of at least 2° C., preferably approximately 160° C., above the martensite transformation point of the alloy. The rail track is then at least partially removed from the coolant such that only the higher mass section(s) continue to cool in an accelerated manner (this may require intermit immersion and removal into the coolant).

If the amount of coolant applied to the surface of the rolling stock is adjusted to the mass concentration, the heat technology for the usual alloyed rail steel can be specified. The heat treatment can be controlled such that a structural transformation into the lower intermediary phase structure occurs essentially over the entire cross section of the stock.

In the alternative, if additional time is required for transformation, and to apply a uniform accelerated cooling along the longitudinal axis, the rolling stock can, after rolling using the rolling heat, be straightened axially and exposed to the coolant to produce particular material properties over the cross section during the transformation.

The process according to the invention is particularly advantageous for high performance rails if, after rolling and at least partial thermal transformation to the lower phase intermediary structure, the rail is subject to a subsequent straightening process, in particular a bending straightening process, at room temperature (or slightly higher). This can obtain particular material properties with a stable alignment of the rail.

The invention will be explained in detail below in conjunction with test results and the development and exemplary embodiments. The intent is to produce a rolling stock with an essentially H-shaped profile, a hardness between 550 and 600 HV, with the maximum possible toughness. The selected iron-based alloy included, in wt. %: C=1.05, Si=0.28, Mn=0.35, Cr=1.55, and a remainder of iron and impurities.

Figure 2:
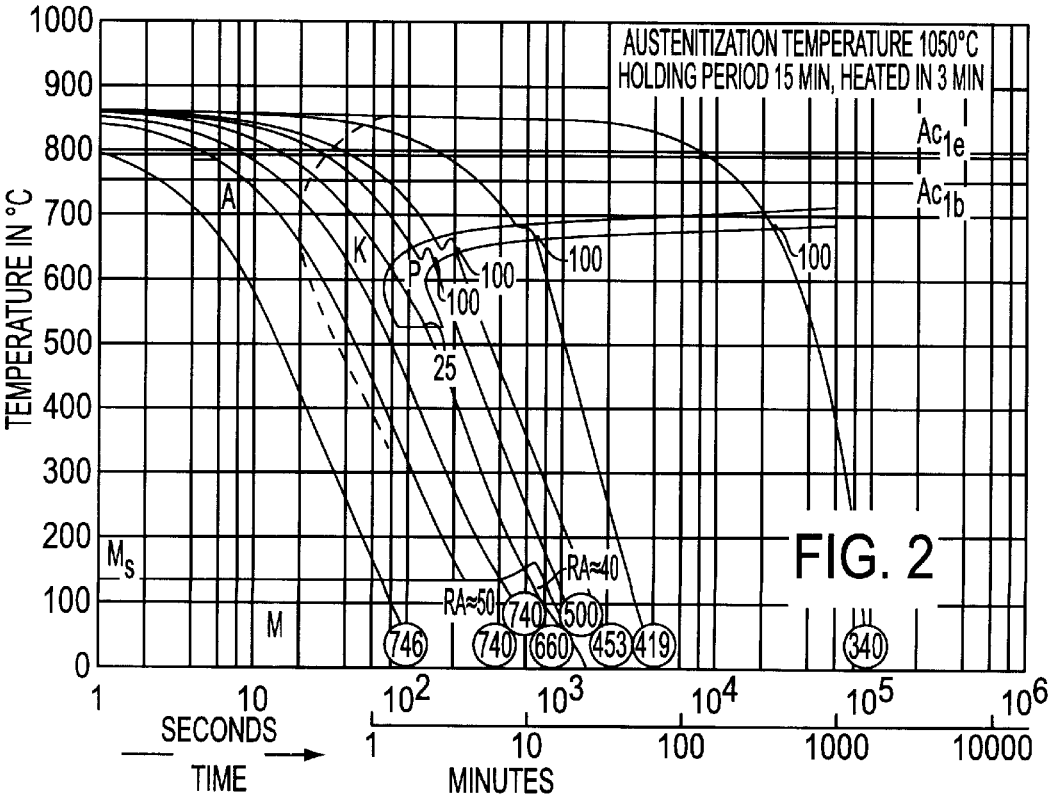
FIG. 2 is a continuous time-temperature transformation curve of an alloy from an austenitizing temperature of 1050° C.
Figure 3:
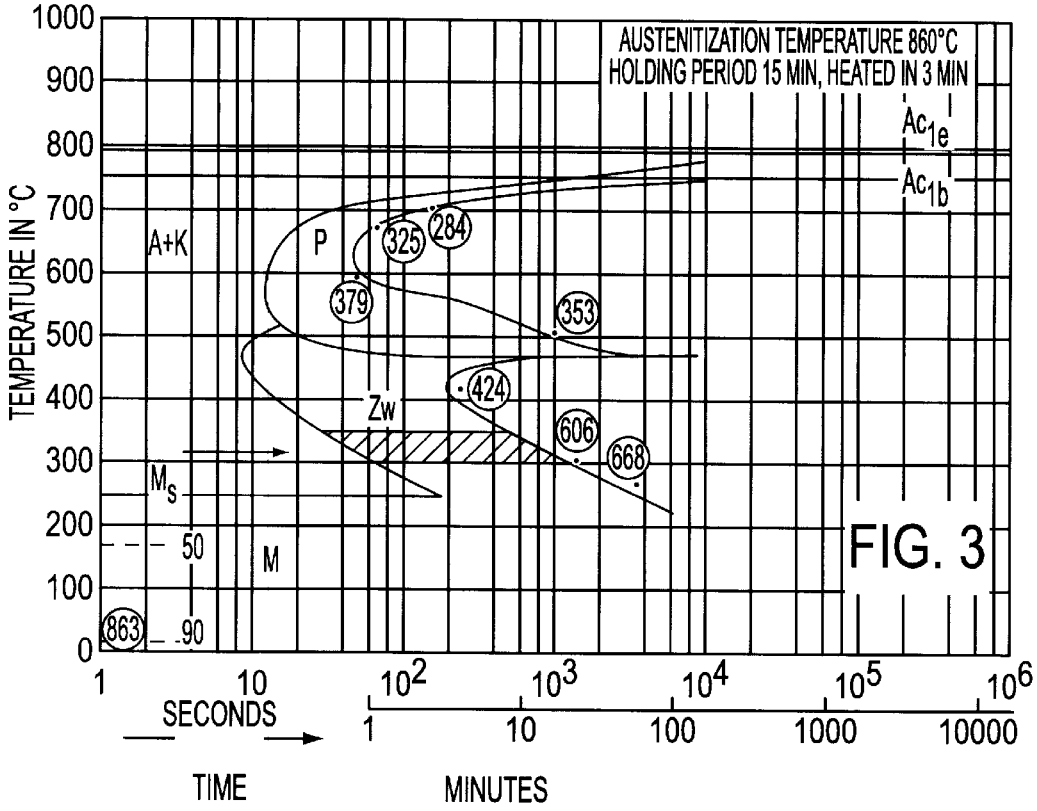
FIG. 3 is an isothermic time-temperature transformation curve for an alloy from an austenitizing temperature of 860° C.
Figure 4:
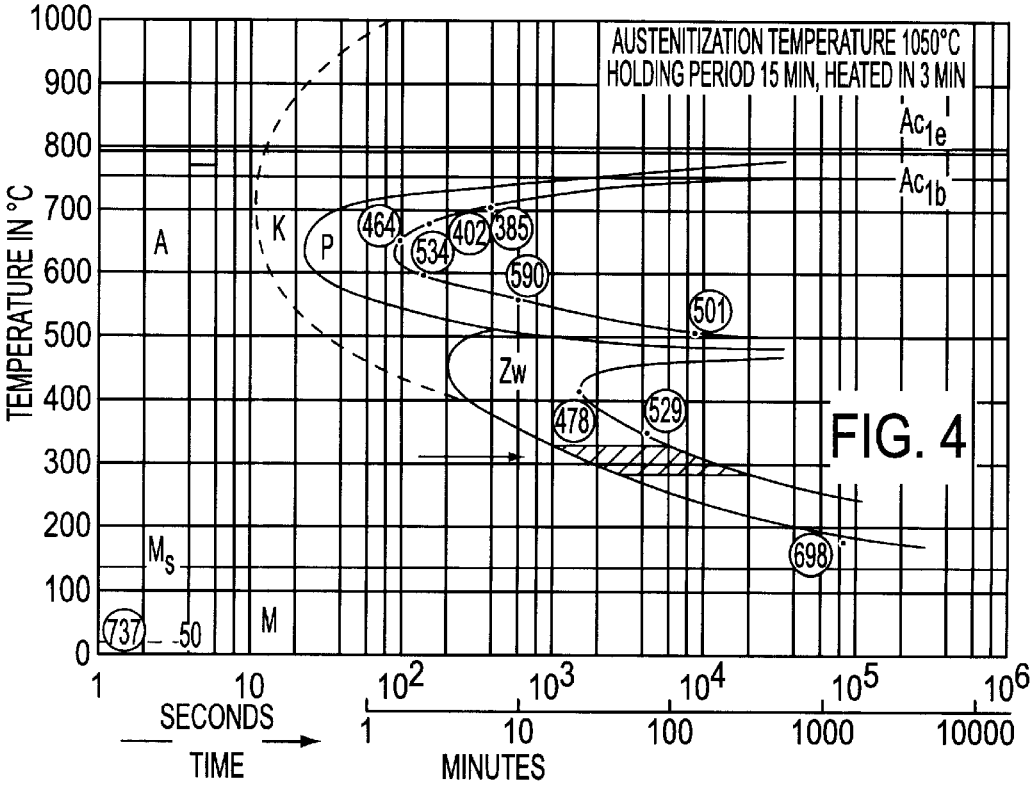
FIG. 4 is an isothermic time-temperature transformation curve for an alloy from an austenitizing temperature of 1050° C.

FIGS. 1 and 2 show continuous time-temperature transformation curves using austenitizing temperatures of 860° C. and 1050° C. for the above alloy. FIGS. 3 and 4 are isothermic time-temperature transformation curves at austenitizing temperatures of 860° C. and 1050° C. of the alloy. The curves coincide with those known from literature for this type of alloy.

In samples that were cooled in an accelerated manner from an austenitizing temperature of 860° C. (FIG. 1), material hardness (numerical value in the circle) between 530 to 600 HV were difficult to obtain. The resulting structure was a mixture of structures from the essentially upper intermediary stage, lower intermediary stage, and martensite, such that the material had poor strength values.

In the test shown in FIG. 2, raising the austenite temperature to 1050° C. largely stopped the intermediary phase conversion. With continuous cooling, the obtained structure contained pearlite and martensite in the desired hardness region, yet did not reach the expected high strength values of the material.

Referring now to FIG. 3, samples of this alloy were cooled in an accelerated fashion from a temperature of 860° C. and permitted to transform isothermically between 350° C. and 300° C. (the transformation temperature range, see the arrow in FIG. 3), i.e., 155° C. and 105° C. above the martensite transformation point Ms. The process repeatedly produced a homogeneous lower intermediary phase structure with a material hardness of 550 to 600 HV, and significantly increased material strength values.

Referring now to FIG. 4, with an increased austenitizing temperature, the conversion required a longer period of time for the isothermic transformation in the lower intermediary region. To achieve a material hardness of 550 to 600 HV. Holding the alloy for 20 to 340 minutes at a temperature between 330° C. and 280° C. (see the arrow in FIG. 4) produced extremely high material toughness values.

The above tests show that an isothermic conversion of rolling stock, preferably rails, in the lower intermediate region of the alloy, produces on the one hand high material hardness and toughness. By controlling the temperature on the other hand, the manufacturing conditions and the required time spans in the material flow can be taken into account to meet desired quality values of the product.

Railroad tracks were produced from a steel with the composition, in wt. %, C=0.30, Si=0.30, Mn=1.08, Cr=1.11, Ni=0.04, Mo=0.09, V=0.15, Al=0.016, with a remainder of iron and companion elements, with an average rolling end surface temperature of 1045° C. After precise alignment of the rolling stock along its longitudinal axis, the rail was transported to a cooling device. In the cooling device, the surface was cooled until peripheral regions of the rail foot reached a surface temperature of 290° C. In these regions, the intensity of the application of coolant was reduced or eliminated. Then, regions with a higher mass and comparatively higher temperature (in particular the rail head), were subject to accelerated cooling to bring those surface temperatures to 290° C. The accelerated cooling is preferably an intermittent cooling (or similar regulation of the application of coolant).

The rail thus cooled was placed in an oven (or heat retention chamber) at a temperature of approximately 340° C. After the alloy transformed into the lower intermediary phase structure, the unit was cooled to room temperature.

Figure 5:
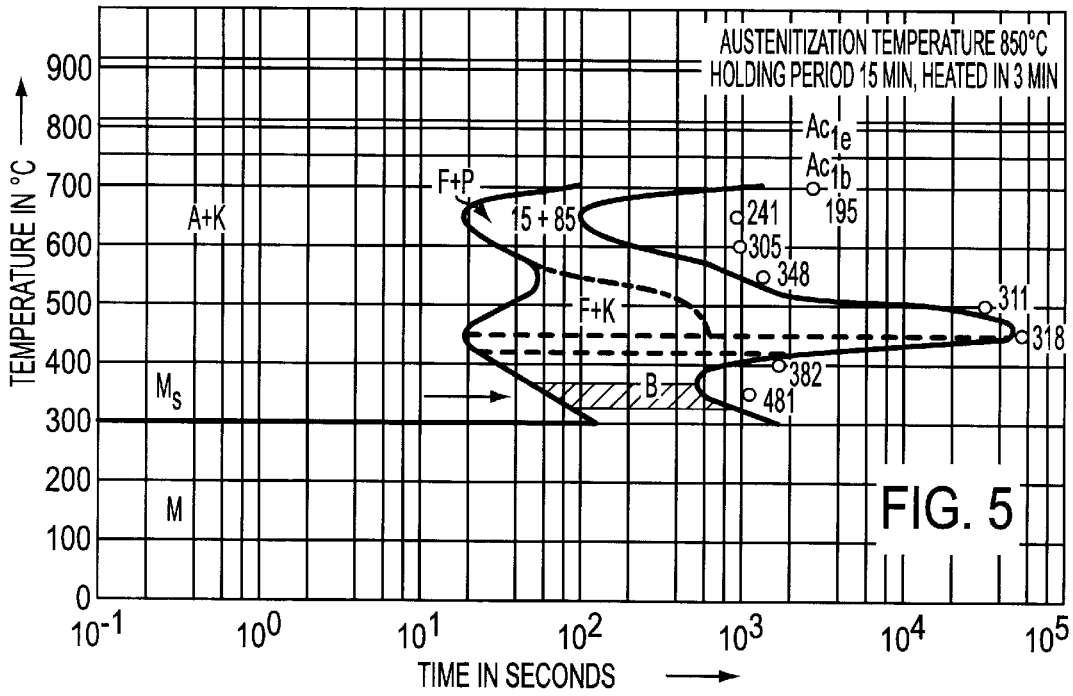
FIG. 5 is an isothermic time-temperature transformation curve for an alloy as a function of an austenitizing temperature of 850° C. with a martensite transformation point Ms of 300° C.
Figure 6:
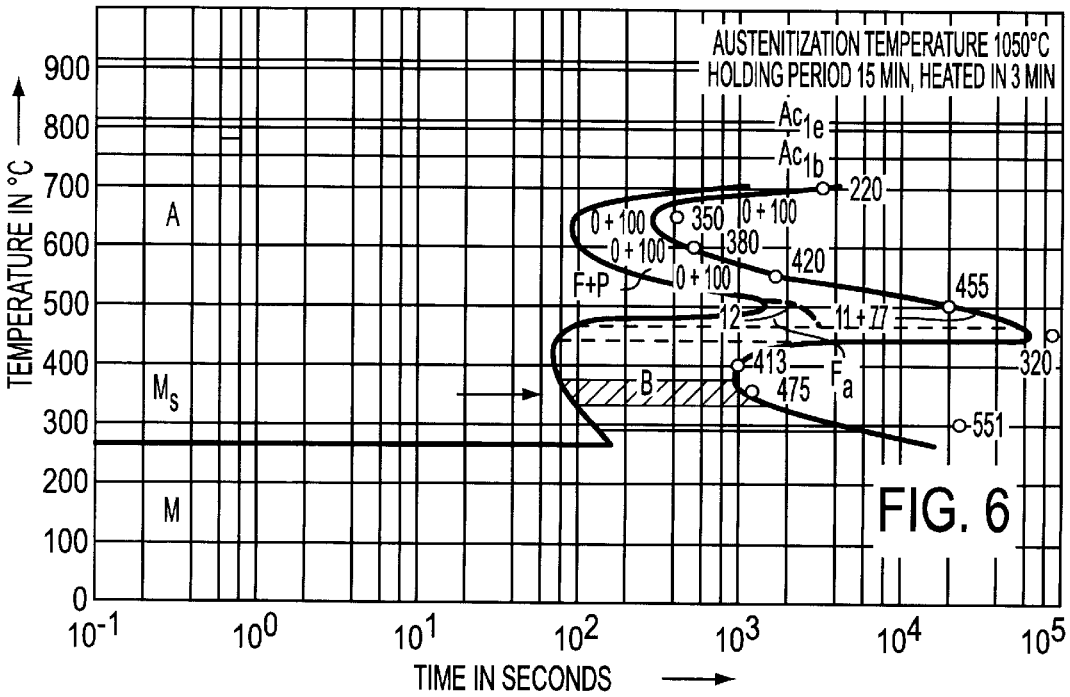
FIG. 6 is an isothermic time-temperature transformation curve for an alloy from as a function of an austenitizing temperature of 1050° C. with a martensite transformation point of 260° C.

FIG. 5 shows an isothermic time-temperature transformation curve generated from the test results as a function of the austenitizing temperature for 850° C. with a martensite transformation point Ms of 300° C. FIG. 6 shows a similar curve at an austenitizing temperature of 1050° C. with a martensite transformation point of 260° C. These results show that the optimal temperature to promote transformation into the lower intermediary phase structure is approximately 340° C.

The above tests produce a finished product with a lower intermediary phase structure over the entire cross section. The hardness on the rail head was 475 HB, with only minor deviations over the entire rail cross section. The material toughness, measured in notched bar impact tests, was similarly significantly improved. The fracture toughness test produced values $K_{ic}$ of greater than 2300 $N/mm^{3/2}$.

While the invention has been described with reference to several exemplary embodiments, it is understood that the words which have been used herein are words of description and illustration, rather than words of limitations. Changes may be made, within the purview of the pending claims, as without affecting the scope and spirit of the invention and its aspects. While the invention has been described here with reference to particular means, materials and embodiments, the invention is not intended to be limited to the particular disclosed herein; rather, the invention extends to all functionally equivalent structures, methods and uses, such at all within the scope of the appended claims.

What is claimed is:

1. A rolling stock comprising an iron-based alloy containing up to about 0.93 wt % silicon and an amount of aluminum greater than zero wt % and up to about 0.06 wt %, with a structure over the cross section formed, at least partially, by accelerated cooling from the austenite region of the alloy, wherein said structure is a bainitic microstructure substantially the result of isothermic structural transformation as the alloy is cooled from the austenite phase of the alloy to a lower intermediary temperature region above the martensite transformation point, said rolling stock having a hardness less than about 560HB.

2. The rolling stock of claim 1, wherein said concentration of silicon is within about 0.21 to 0.69 wt % of said iron-based alloy.

3. The rolling stock of claim 1, a total amount of said silicon and said aluminum being up to about 0.99 wt % of said iron-based alloy.

4. The rolling stock of claim 3, wherein said aluminum is up to about 0.03 wt % of said iron-based alloy.

5. The rolling stock according to claim 1, said iron-based alloy further comprising about 0.41 to 1.3 wt % carbon, about 0.31 to 2.55 wt % manganese, and iron.

6. The rolling stock of claim 5, wherein said carbon is about 0.51 to 0.98 wt % of said iron-based alloy.

7. The rolling stock of claim 5, wherein said manganese is about 0.91 to 1.95 wt % of said iron-based alloy.

8. The rolling stock of claim 1, said iron-based alloy further comprising about 0.21 to 2.45 wt % chromium.

9. The rolling stock of claim 1, said iron-based alloy furthermore comprising about 0.39 to 1.95 wt % chromium.

10. The rolling stock of claim 1, said iron-based alloy further comprising up to about 0.88 wt % molybdenum.

11. The rolling stock of claim 1, said iron-based alloy further comprising up to about 0.49 wt % molybdenum.

12. The rolling stock of claim 1, said iron-based alloy further comprising up to about 1.69 wt % tungsten.

13. The rolling stock of claim 1, said iron-based alloy further comprising up to about 0.95 wt % tungsten.

14. The rolling stock of claim 1, said iron-based alloy further comprising up to about 0.39 wt % vanadium.

15. The rolling stock of claim 1, said iron-based alloy further comprising up to about 0.19 wt % vanadium.

16. The rolling stock of claim 1, said iron-based alloy further comprising up to about 0.28 wt % total niobium, tantalum, zirconium, hafnium, and titanium.

17. The rolling stock of claim 1, said iron-based alloy further comprising up to about 0.19 wt % total niobium, tantalum, zirconium, hafnium, and titanium.

18. The rolling stock of claim 1, said iron-based alloy further comprising up to about 2.4 wt % nickel.

19. The rolling stock of claim 1, said iron-based alloy further comprising up to about 0.95 wt % nickel.

20. The rolling stock of claim 1, said iron-based alloy further comprising up to about 0.006 wt % boron.

21. The rolling stock of claim 1, said iron-based alloy further comprising up to about 0.004 wt % boron.

22. The rolling stock of claim 1, wherein an amount of silicon, aluminum, and carbon, in wt %, in said iron-based alloy satisfies the following relationship:

$$2.75(\text{silicon}+\text{aluminum})-\text{carbon}\leq 2.2$$

23. The rolling stock of claim 1, wherein said rolling stock is a railroad track including a rail head, a rail foot, and an intermediary piece connecting said rail head and rail foot, said structure reaching at least about 10 mm below a surface of said rail head.

24. The rolling stock of claim 23 wherein said structure reaches at least about 15 mm below said surface of said rail head.

25. The rolling stock of claim 1, wherein said structure is disposed symmetrically about a longitudinal axis of said rolling stock.

26. The rolling stock of claim 1, wherein any portion of said rolling stock containing said structure has a hardness of at least about 350 HB.

27. The rolling stock of claim 26, wherein said hardness is at least about 400 HB.

28. The rolling stock of claim 26, wherein said hardness is between about 420 HB to about 560 HB.

29. A method for producing profiled rolling stock from an iron-based alloy containing at least silicon, comprising:

selecting a concentration of components that make up said alloy;

cooling at least a portion of the cross section of the rolling stock from the austenite temperature region of said alloy to a transformation temperature range within a lower intermediary temperature region of the alloy between over 15° C. above the martensite transformation point of the alloy and about 250° C. above the martensite transformation point; and maintaining said at least a portion of the cross section within said transformation temperature region to permit the alloy to isothermically transform.

30. The method of claim 29, wherein said lower intermediary temperature region is below about 190° C. above the martensite transformation point.

31. The method of claim 29, wherein said lower intermediary temperature region is below about 110° C. above the martensite transformation point.

32. The method according to claim 29, wherein said transformation temperature range is less than or equal to about 220° C. wide.

33. The method according to claim 29, wherein said transformation temperature range is less than of equal to about 120° C. wide.

34. The method of claim 29, wherein an upper limit of said transformation temperature range is less than or equal to about 450° C.

35. The method of claim 29, wherein an upper limit of said transformation temperature is less than or equal to about 400° C.

36. The method of claim 29, wherein a lower limit of said transformation temperature is above about 300° C., and an upper limit of said transformation temperature range is below about 380° C.

37. The method of claim 29, wherein at least a portion of a cross section of the rolling stock having a higher mass is subject to an accelerated cooling.

38. The method of claim 29, wherein said cooling comprises applying coolant to a surface of said rolling stock in an amount and in a manner based on a mass of the rolling stock.

39. The method of claim 29, wherein said cooling comprises:

immersing the rolling stock into a coolant until at least a portion of the surface has a surface temperature at least over 15° C. above the martensite transformation point of the alloy;

at least partially removing said rolling stock from the coolant; and intermittently cooling only those sections of the rolling stock having the highest mass.

40. The method of claim 39, wherein said immersing comprises keeping the rolling stock in the coolant until at least a portion of the surface reaches a surface temperature least about 160° C. above the martensite transformation point of the alloy.

41. The method of claim 29, further comprising axially aligning the alloy before said cooling.

42. The method of claim 29, further comprising, after at least partial thermal transformation of the alloy during said permitting, straightening said alloy at a temperature greater than or equal to room temperature to obtain the particular material properties with a stable alignment of the material.

43. The method of claim 29, wherein said permitting comprises maintaining said alloy within said transformation temperature range for a fixed period of time.

44. A profiled rolling stock made of an iron-based alloy including carbon, aluminum, silicon, manganese, and at least one of chromium, elements that form special carbides that also influence the conversion behavior of the material, micro-alloy additives, residual iron, and both standard and manufacture conditional impurities, a structure formed over the cross section at least partially by isothermic structural conversion from accelerated cooling from the austenite region of the alloy to the region of the lower bainite stage, and held in said region of the lower bainite stage to permit said isothermic structural transformation, wherein the iron-based alloy has a concentration, in wt. %, of up to about 0.93% silicon, aluminum greater than zero and up to about 0.06% and a total of silicon plus aluminum below about 0.99%, and said rolling stock has a hardness between about 420 HB and about 560 HB.

45. The rolling stock of claim 1, wherein said structure is a bainitic structure.

46. The rolling stock of claim 29, wherein said maintain comprises placing said alloy in one of an oven and heat retention chamber for a fixed period of time.

47. The rolling stock of claim 44, wherein said structure bainitic structure.

48. A rolling stock comprising an iron-based alloy containing up to about 0.93 wt % silicon, with a structure over the cross section formed, at least partially, by accelerated cooling from the austenite region of the alloy, wherein said structure is a bainitic microstructure substantially the result of isothermic structural transformation as the alloy is cooled from the austenite phase of the alloy to a lower intermediary temperature region above the martensite transformation point, and held in said lower intermediary temperature region to permit said isothermic structural transformation, said rolling stock having a hardness between about 420 HB and about 560HB.

49. The rolling stock of claim 1, wherein said iron-based alloy further comprisies less than 0.4 wt % molybdenum.

50. The rolling stock of claim 44, wherein said iron-based alloy further comprisies less than 0.4 wt % molybdenum.

51. The rolling stock of claim 48, wherein said iron-based alloy further comprises less than 0.4 wt % molybdenum.

* * * * *